US011691049B2

(12) United States Patent
Bibbs

(10) Patent No.: US 11,691,049 B2
(45) Date of Patent: Jul. 4, 2023

(54) ADJUSTABLE PUSH-UP APPARATUS

(71) Applicant: William Devar Bibbs, Las Vegas, NV (US)

(72) Inventor: William Devar Bibbs, Las Vegas, NV (US)

( * ) Notice: Subject to any disclaimer, the term of this patent is extended or adjusted under 35 U.S.C. 154(b) by 0 days.

(21) Appl. No.: 17/304,996

(22) Filed: Jun. 29, 2021

(65) Prior Publication Data

US 2022/0409956 A1 Dec. 29, 2022

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 21/055*** | (2006.01) |

(52) U.S. Cl.

CPC ..... *A63B 23/1236* (2013.01); *A63B 21/0552* (2013.01); *A63B 21/068* (2013.01); *A63B 21/4035* (2015.10); *A63B 21/4045* (2015.10); *A63B 2225/093* (2013.01)

(58) Field of Classification Search

CPC ..... A63B 21/0552; A63B 21/068; A63B 21/4035; A63B 21/4045; A63B 23/1236; A63B 2225/093

See application file for complete search history.

(56) References Cited

U.S. PATENT DOCUMENTS

| | | | | |
|---|---|---|---|---|
| 3,797,824 | A * | 3/1974 | Osbourne | A63B 22/203 482/132 |
| 4,111,417 | A * | 9/1978 | Gardner | A63B 23/03533 482/130 |
| 4,923,194 | A * | 5/1990 | Montgomery | A63B 21/00047 482/141 |
| 5,697,875 | A * | 12/1997 | Stan | A63B 21/00047 482/141 |
| 6,129,651 | A * | 10/2000 | Denaro | A63B 21/00047 482/141 |
| 6,186,930 | B1 * | 2/2001 | Ignaczak | A63B 21/4035 482/141 |
| 6,716,145 | B1 * | 4/2004 | Manailovich | A63B 21/4035 482/141 |
| 7,108,643 | B2 * | 9/2006 | Wilson | A63B 23/03533 482/141 |
| 7,125,367 | B1 * | 10/2006 | Stearns | A63B 23/1245 482/141 |
| 7,134,987 | B2 * | 11/2006 | Goldstein | A63B 21/4045 482/141 |

(Continued)

*Primary Examiner* — Joshua Lee

(74) *Attorney, Agent, or Firm* — Squire Patent Consulting & IP Law LLC; Brendan E. Squire

(57) ABSTRACT

An exercise apparatus for performing push-up type exercises includes an elongate planar surface with at least one transverse slot and a pair of handles movably carried in the transverse slot. The pair of handles are adapted for gripping by a user during performance of the push-up type exercise. The handles are interconnected by a resistance band for providing a selected resistance to resist a laterally outward displacement of the pair of handles during a push-up. A pair of adjustable legs support the apparatus in inclined orientation and a declined orientation, relative to a supporting ground surface. The legs may be attached by a pivot and are movable between a stowed position and an upright supporting position.

13 Claims, 2 Drawing Sheets

(56) References Cited

U.S. PATENT DOCUMENTS

| | | | | |
|---|---|---|---|---|
| 7,658,702 | B1 * | 2/2010 | Harms | A63B 21/4029 482/141 |
| 9,022,911 | B2 * | 5/2015 | Goldberg | A63B 21/0442 482/133 |
| 9,700,757 | B2 * | 7/2017 | Shade | A63B 23/035 |
| 2005/0148448 | A1 * | 7/2005 | Mersch | A63B 21/4035 482/141 |
| 2008/0045390 | A1 * | 2/2008 | Harms | A63B 21/4029 482/141 |
| 2012/0329619 | A1 * | 12/2012 | Goldberg | A63B 21/0442 482/142 |
| 2015/0290486 | A1 * | 10/2015 | Leone | A63B 23/1236 482/96 |
| 2016/0008656 | A1 * | 1/2016 | Critelli | A63B 23/1236 482/95 |

* cited by examiner

ADJUSTABLE PUSH-UP APPARATUS

BACKGROUND OF THE INVENTION

The present invention relates to exercise apparatus, and more particularly to apparatus for push-up type exercises.

Push-ups are a long standing fitness exercise directed to developing the chest, triceps, and shoulder girdle of the fitness enthusiast. The push-up may be performed in various ways, close grip, wide grip, normal grip, inclined, declined, etc., depending on the muscle groups that the user is targeting and the fitness level of the fitness enthusiast. However, once the fitness enthusiast has reached a high level of fitness in the various, one of the few ways of increasing the intensity of the workout is simply by adding repetitions. This can lead to a certain level of boredom for the fitness enthusiast.

To accommodate this challenge, various push-up apparatus have been developed. These conventional apparatus generally have a pair of handgrips that are maintained in a static orientation often tailored to a targeted muscle group. While these apparatus can improve the intensity of the workout, they remain limited in their adaptability to the fitness enthusiast's level of fitness.

As can be seen, there is a need for improved exercise apparatus for performing push-up type exercises in a fitness regimen.

SUMMARY OF THE INVENTION

In one aspect of the present invention, an exercise apparatus for performing push-up type exercises is disclosed. The exercise apparatus includes an elongate planar surface having a pair of adjustable legs adapted to support the elongate planar surface in one or more of an inclined orientation and a declined orientation. At least one transverse slot is defined in the elongate planar surface. A pair of handles are movably carried in the at least one transverse slot. The pair of handles are adapted for gripping by a user during performance of the push-up type exercise.

In some embodiments, a handle carrier is disposed on an opposite side of the elongate planar surface and is configured to movably carry the pair of handles along the at least one transverse slot.

In some embodiments, a resistance band interconnects each handle carrier. The resistance band imparts a desired resistance to a laterally outward movement of the pair of handles. The resistance band may be adjustably coupled to the handle carrier to set a desired separation between the pair of handles.

In some embodiments, a pivot couples the pair of adjustable legs to the elongate planar surface, such that the pair of adjustable legs may be selectively positioned between a stowed condition aligned with a back surface of the elongate planar surface, and an extended position, such that a front or a back of the elongate planar surface is inclined or declined relative to a supporting ground surface.

In other embodiments, a shock strut compressively supports the elongate planar surface on the supporting ground surface responsive to a user's performance of a push-up exercise.

In other aspects of the invention, an exercise apparatus is disclosed. The exercise apparatus includes an elongate planar surface and at least one transverse slot defined in the elongate planar surface. A pair of handles are movably carried in the at least one transverse slot. The pair of handles are adapted for gripping by a user during performance of a push-up type exercise. A resistance band interconnects the pair of handles for providing a selected resistance to resist a laterally outward displacement of the pair of handles.

In some embodiments, a pair of adjustable legs are adapted to support the elongate planar surface in one or more of an inclined orientation and a declined orientation, relative to a supporting ground surface.

In some embodiments, a pivot couples the pair of adjustable legs to the elongate planar surface. The pair of adjustable legs are selectively positioned between a stowed condition, aligned with a back surface of the elongate planar surface, and an extended position, such that a front or a back of the elongate planar surface is inclined or declined relative to a supporting ground surface.

In yet other embodiments, a handle carrier is coupled to each of the pair of handles. The resistance band is adjustably coupled to the handle carrier to set a desired separation between the pair of handles.

These and other features, aspects and advantages of the present invention will become better understood with reference to the following drawings, description and claims.

DETAILED DESCRIPTION

Figure 1:
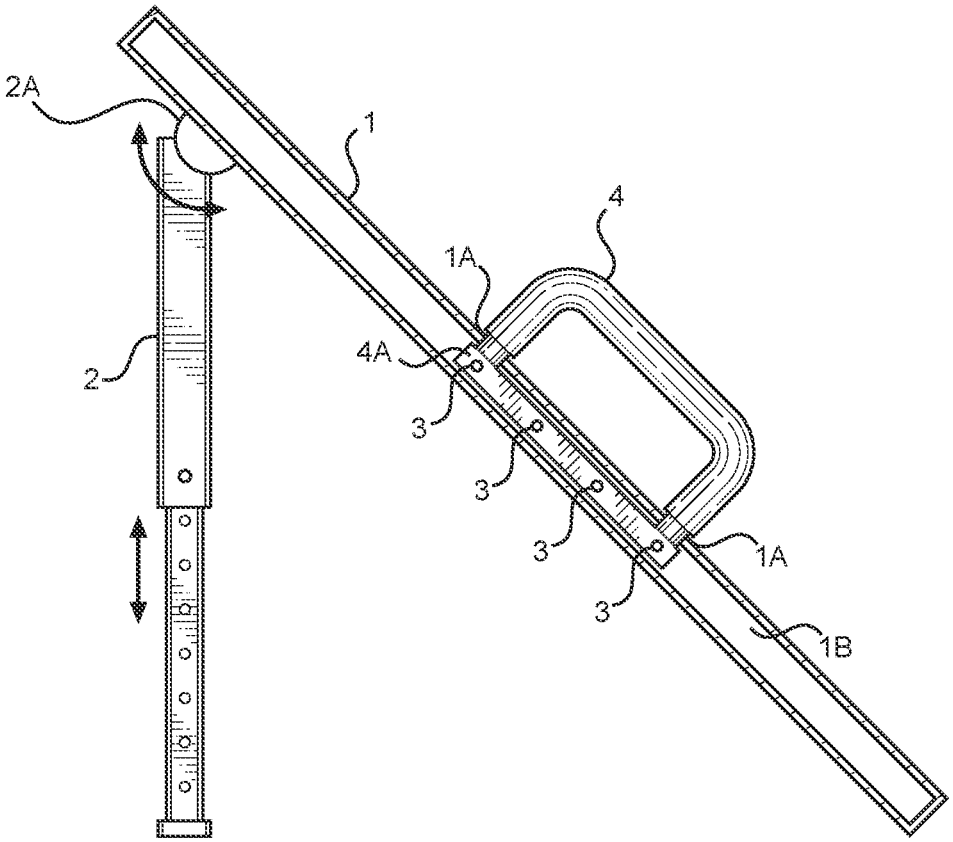
FIG. 1 is a cross-section of the push-up apparatus.
Figure 2:
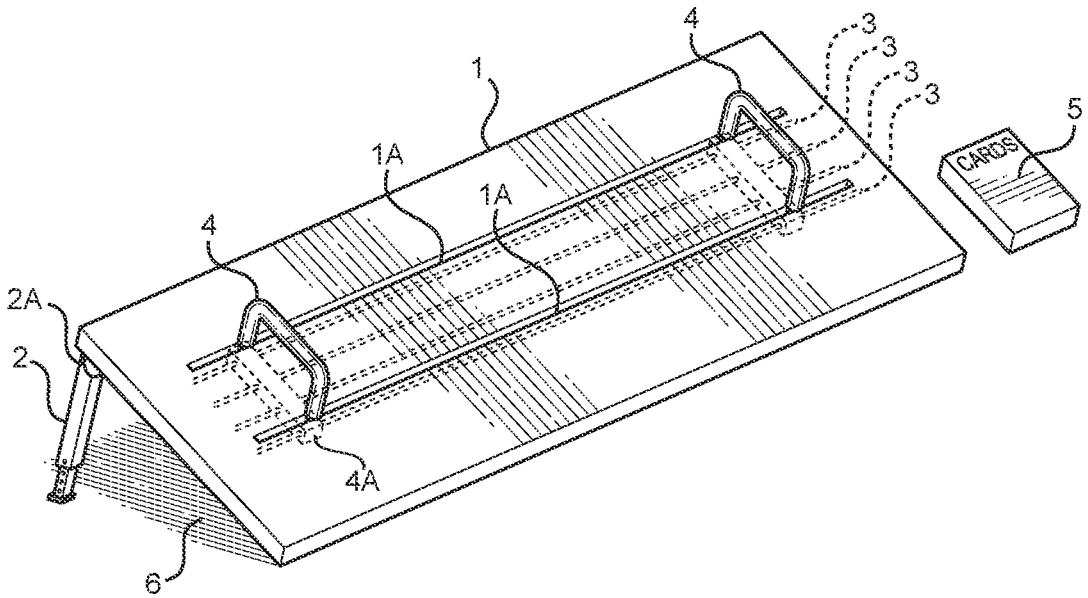
FIG. 2 is a perspective view of the push-up apparatus and accompanying deck of cards.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide an improved exercise apparatus for performing push-up type exercises to develop strength and fitness of the chest and arms.

As seen in reference to the drawings of FIGS. 1-5, the exercise apparatus includes an elongate planar surface 1. The planar surface 1 is supported at an aft end by a leg 2 to orient the elongate planar surface 1 in one or more of an inclined orientation and a declined orientation relative a supporting ground surface 6. The leg 2 may be adjustable in length to selectively increase or decrease the angle of incline/decline of the exercise apparatus. The leg 2 may also be foldable about a pivot point 2A so that the exercise apparatus may be utilized in a flat orientation on the ground surface 6. The leg 2, may also include a compressible, shock absorbing strut that compressively supports the elongate planar surface 1 responsive forces developed by the user during the performance of push-ups with the exercise apparatus.

One or more transverse slots 1A are defined laterally across the elongate planar surface 1. A pair of handles 4 are movably carried for a lateral displacement along the one or more transverse slots 1A. A handle carrier 4A is disposed on an opposite side of the elongate planar surface 1 to movably carry the pair of handles 4 along the at least one or more transverse slots 1A. The elongate planar surface 1 may also include an interior cavity 1B in which the handle carrier 4A are contained. Preferably, a pair of transverse slots, aligned in parallel assist with maintaining a vertical alignment of the handles 4.

One or more resistance bands 3 may be interconnect the handle carriers 4A. An exercise resistance may be set based on the number and resistance of the one or more resistance bands 3. The one or more resistance bands 3 may be adjustably coupled to the handle carrier 4A to position the handles 4 at a desired lateral separation, such as a close grip, or a wide grip.

During an exercise regimen, the user may grasp the handles 4 and assume a push-up position holding the handles 4. The user may then lower their upper torso towards the elongate planar surface 1. Depending on the resistance of the one or more resistance bands 3, the exercise apparatus provides an enhanced push-up exercise regimen. If a strong resistance is selected, the user may perform a normal, or near normal push-up type exercise, where the handles 4 and user's hands remain stationary or near stationary at the desired lateral separation. When a lighter resistance is selected, the handles may move outwardly during performance of the push-up. The user may then expend additional effort to retain the handles 4 at the desired separation. Alternatively, the user may expend additional effort in allowing the handles 4 to move laterally during performance of the push-up exercise. In each use, different muscle groups may be targeted. Likewise, this configuration permits either an isometric or a kinetic targeting of the selected muscle groups.

Figure 3:
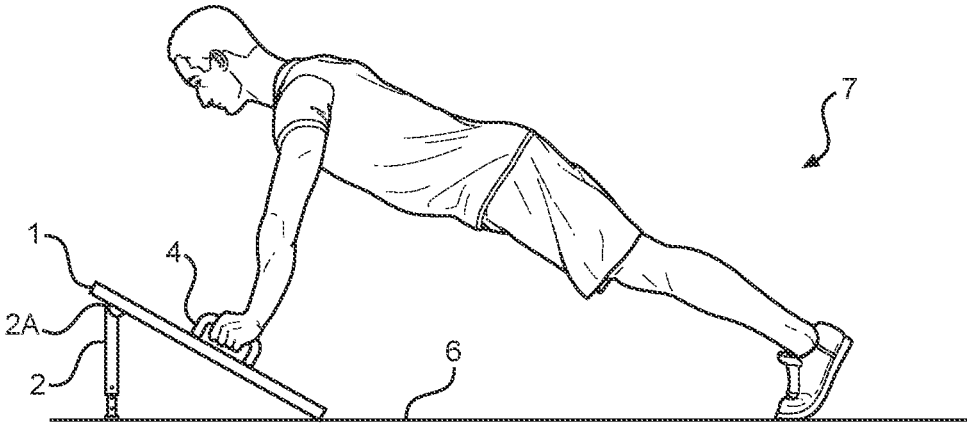
FIG. 3 is a side view of the push-up apparatus in-use.
Figure 4:
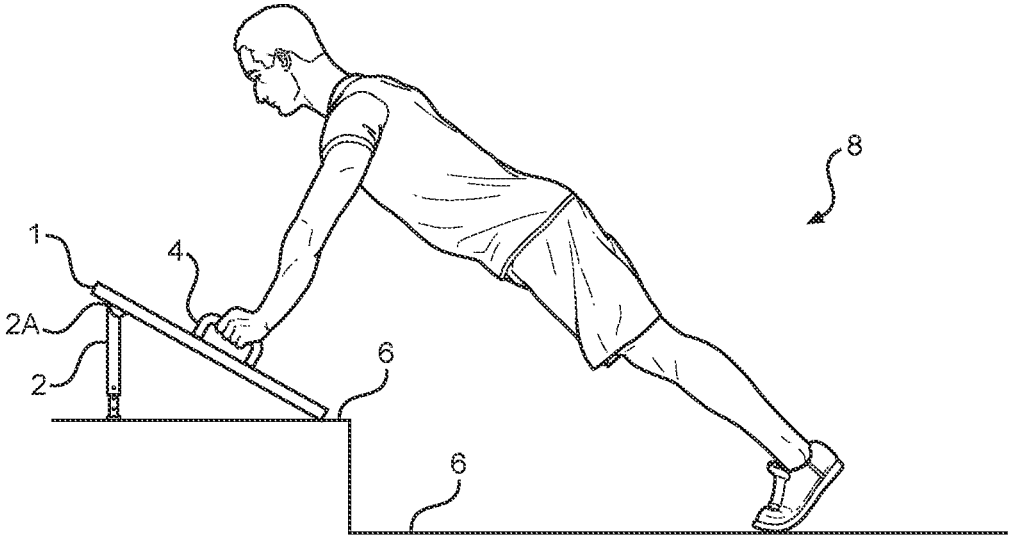
FIG. 4 is a side view of the push-up apparatus in-use.
Figure 5:
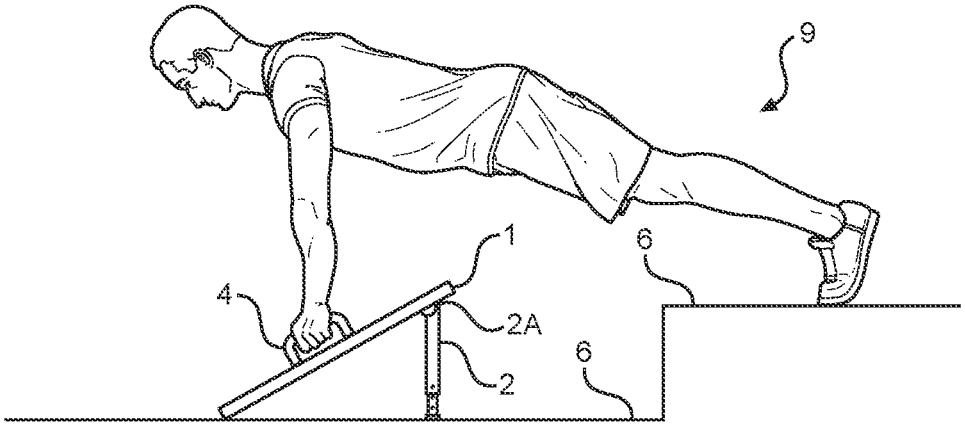
FIG. 5 is a side view of the push-up apparatus in-use.

As will be appreciated from the drawings of FIGS. 3-5, the user may position the exercise apparatus on a flat ground surface 6, with the legs 2 in one of an extended or a retracted position. The height of the legs 2 may be adjusted for a desired incline 7. Likewise, the exercise apparatus may be positioned on a supporting surface in an elevated 8 or a lowered position 9 from the user, such as on a stairway. For beginning users, the elevated position 8 will allow the user to perform a correct push-up with less exertion. As the user gains strength, the exercise apparatus may be progressively moved to an even surface 7 with the user. For advanced users, the exercise apparatus may be positioned in a lowered position 9 relative to the user, requiring a greater exertion to perform the push-up exercise.

The exercise apparatus of the present invention may also include a deck of cards 5. The cards may have a number of repetitions the user is to perform, an orientation of the elongate planar surface 1, a lateral spacing of the handles 4, and/or a number or resistance of the resistance bands 3. The cards may be utilized to add some variety to the exercise regimen.

It should be understood, of course, that the foregoing relates to exemplary embodiments of the invention and that modifications may be made without departing from the spirit and scope of the invention as set forth in the following claims.

What is claimed is:

1. An exercise apparatus, comprising:

an elongate planar surface having a pair of adjustable legs adapted to support the elongate planar surface in one or more of an inclined orientation and a declined orientation;

at least one transverse slot defined in the elongate planar surface; and a pair of handles movably carried in the at least one transverse slot, the pair of handles adapted for gripping by a user during performance of a push-up type exercise;

a pair of handle carriers disposed on opposite sides of the elongate planar surface, each handle carrier configured to movably carry a respective handle of the pair of handles along the at least one transverse slot; and a resistance band interconnecting the pair of handle carriers, the resistance band imparting a desired resistance to a laterally outward movement of the pair of handles.

2. The exercise apparatus of claim 1, wherein each handle carrier is disposed within a cavity below the elongate planar surface.

3. The exercise apparatus of claim 2, wherein the resistance band interconnects the pair of handle carriers within the cavity.

4. The exercise apparatus of claim 3, wherein the resistance band is adjustably coupled to the pair of handle carriers to set a desired separation between the pair of handles.

5. The exercise apparatus of claim 1, further comprising:

a pivot coupling the pair of adjustable legs to the elongate planar surface, such that the pair of adjustable legs are selectively positioned between a stowed condition aligned with a back surface of the elongate planar surface, and an extended position, such that a front or a back of the elongate planar surface is inclined or declined relative to a supporting ground surface.

6. The exercise apparatus of claim 5, further comprising:

a shock strut compressively supporting the elongate planar surface on the supporting ground surface responsive to a user's performance of a push-up exercise.

7. An exercise apparatus, comprising:

an elongate planar surface;

at least one transverse slot defined in the elongate planar surface;

a pair of handles movably carried in the at least one transverse slot, the pair of handles adapted for gripping by a user during performance of a push-up type exercise;

a resistance band interconnecting the pair of handles for providing a selected resistance to resist a laterally outward displacement of the pair of handles; and a pair of adjustable legs adapted to support the elongate planar surface in one or more of an inclined orientation and a declined orientation, relative to a supporting ground surface.

8. The exercise apparatus of claim 7, further comprising:

a pivot coupling the pair of adjustable legs to the elongate planar surface, such that the pair of adjustable legs are selectively positioned between a stowed condition aligned with a back surface of the elongate planar surface, and an extended position, such that a front or a back of the elongate planar surface is inclined or declined relative to a supporting ground surface.

9. The exercise apparatus of claim 8, further comprising:

a handle carrier coupled to each of the pair of handles, wherein the resistance band is adjustably coupled to the handle carrier to set a desired separation between the pair of handles.

10. An exercise apparatus, comprising:

an elongate planar surface having a pair of adjustable legs adapted to support the elongate planar surface in one or more of an inclined orientation and a declined orientation;

at least one transverse slot defined in the elongate planar surface; and a pair of handles movably carried in the at least one transverse slot, the pair of handles adapted for gripping by a user during performance of a push-up type exercise; and a pivot coupling the pair of adjustable legs to the elongate planar surface, such that the pair of adjustable legs are selectively positioned between a stowed condition aligned with a back surface of the elongate planar surface, and an extended position, such that a front or a back of the elongate planar surface is inclined or declined relative to a supporting ground surface.

11. The exercise apparatus of claim 10, further, comprising:

a pair of handle carriers disposed on opposite sides of the elongate planar surface, each handle carrier configured to movably carry a respective handle of the pair along the at least one transverse slot.

12. The exercise apparatus of claim 11, further comprising:

a resistance band interconnecting the pair of handle carriers, the resistance band imparting a desired resistance to a laterally outward movement of the pair of handles.

13. The exercise apparatus of claim 10, further comprising:

a shock strut compressively supporting the elongate planar surface on the supporting ground surface responsive to a user's performance of a push-up exercise.

* * * * *